US011542958B2

(12) United States Patent
Scholz et al.

(10) Patent No.: US 11,542,958 B2
(45) Date of Patent: Jan. 3, 2023

(54) EXHAUST TURBOCHARGER

(71) Applicant: Dr. Ing. h.c. F. Porsche Aktiengesellschaft, Stuttgart (DE)

(72) Inventors: Jürgen Scholz, Tiefenbronn (DE); Werner Verdoorn, Ludwigsburg (DE); Ralph Ronneburger, Vaihingen/Enz (DE); Alexander Schulz, Maulbronn (DE); Peter Rothenberger, Philippsburg (DE); Michael Schreck, Stuttgart (DE)

(73) Assignee: Dr. Ing. h.c. F. Porsche Aktiengesellschaft

( * ) Notice: Subject to any disclaimer, the term of this patent is extended or adjusted under 35 U.S.C. 154(b) by 0 days.

(21) Appl. No.: 17/522,016

(22) Filed: Nov. 9, 2021

(65) Prior Publication Data

US 2022/0145906 A1 May 12, 2022

(30) Foreign Application Priority Data

Nov. 10, 2020 (DE) ..... 10 2020 129 525.1

(51) Int. Cl.

| | |
|---|---|
| ***F04D 29/58*** | (2006.01) |
| ***F02B 39/00*** | (2006.01) |
| ***F04D 29/049*** | (2006.01) |
| ***F04D 29/043*** | (2006.01) |
| ***F04D 17/10*** | (2006.01) |

(52) U.S. Cl.

CPC ..... *F04D 29/582* (2013.01); *F02B 39/005* (2013.01); *F04D 17/10* (2013.01); *F04D 29/043* (2013.01); *F04D 29/049* (2013.01)

(58) Field of Classification Search

CPC ..... F04D 29/582; F04D 17/10; F04D 29/043; F04D 29/049; F04D 25/024; F04D 25/06; F04D 29/057; F04D 29/059; F04D 29/063; F04D 29/5806; F04D 29/5813; F02B 39/005; F05D 2220/40; F01D 25/16; F01D 25/12; F01D 25/166; F01M 9/10

USPC ..... 418/180

See application file for complete search history.

(56) References Cited

U.S. PATENT DOCUMENTS

| | | | | |
|---|---|---|---|---|
| 4,329,000 A | | 5/1982 | Keske | |
| 5,605,045 A | * | 2/1997 | Halimi | F02B 39/10 417/407 |
| 6,169,332 B1 | * | 1/2001 | Taylor | F01D 15/10 290/31 |
| 8,393,152 B2 | | 3/2013 | Nishida | |

(Continued)

FOREIGN PATENT DOCUMENTS

| | | | |
|---|---|---|---|
| DE | 102013109136 A1 * | 2/2014 | F01D 25/16 |
| DE | 112013000584 T5 | 10/2014 | |

(Continued)

*Primary Examiner* — J. Todd Newton
(74) *Attorney, Agent, or Firm* — RatnerPrestia

(57) ABSTRACT

An exhaust turbocharger has a housing, in which a shaft is mounted by bearings, which carries a turbine wheel, on the one hand, and a compressor wheel, on the other hand. An electric machine has a rotor and a stator. The rotor is secured on the shaft for conjoint rotation therewith and the stator surrounds the rotor radially on the outside. A sleeve, which supports the rotor radially and axially, is arranged between the stator and the rotor. The sleeve has at least one fluid duct, by way of which a cooling fluid can be guided toward the bearings of the shaft.

10 Claims, 2 Drawing Sheets

(56) References Cited

U.S. PATENT DOCUMENTS

| | | | | |
|---|---|---|---|---|
| 11,073,077 | B2 | 7/2021 | Oshita | |
| 2005/0082941 | A1* | 4/2005 | Iida | H02K 7/14 310/90 |
| 2014/0056721 | A1* | 2/2014 | Garrard | F04D 29/5806 29/598 |
| 2014/0056726 | A1* | 2/2014 | Garrard | H02P 29/40 417/372 |
| 2014/0086731 | A1 | 3/2014 | Schmidt et al. | |
| 2015/0322851 | A1 | 11/2015 | Cavagnaro et al. | |
| 2015/0330253 | A1 | 11/2015 | Koch | |
| 2019/0284992 | A1* | 9/2019 | Hoke | F02B 39/005 |

FOREIGN PATENT DOCUMENTS

| | | | | |
|---|---|---|---|---|
| DE | 112013000614 | T5 | 10/2014 | |
| DE | 102015100090 | A1 * | 7/2015 | H02K 15/02 |
| DE | 112007001954 | B4 | 9/2015 | |
| DE | 112018002019 | T5 | 1/2020 | |
| EP | 2158661 | B1 | 9/2017 | |
| JP | 2005012989 | A | 1/2005 | |

* cited by examiner

EXHAUST TURBOCHARGER

CROSS-REFERENCE TO RELATED APPLICATION

This application claims priority to German Patent Application No. 10 2020 129 525.1, filed Nov. 10, 2020, the content of such application being incorporated by reference herein in its entirety.

FIELD OF THE INVENTION

The invention relates to an exhaust turbocharger, in particular for an internal combustion engine of a motor vehicle.

BACKGROUND OF THE INVENTION

In motor vehicles, internal combustion engines charged by a turbocharger are known. In this case, an exhaust gas flow of the internal combustion engine drives a turbine wheel of the turbocharger, which is connected to a compressor wheel, which compresses air in the intake tract of the internal combustion engine before it is fed into the internal combustion engine. As a result, more air is delivered into the intake tract, increasing engine power and engine torque.

In the case of such exhaust turbochargers, however, it is disadvantageous that the response behavior of the exhaust turbocharger is dependent on the exhaust gas flow. Therefore, electrically assisted exhaust turbochargers are known in which an electric machine is integrated into the exhaust turbocharger. Reference is made in this regard to DE 11 2018 002 019 T5, which is incorporated by reference herein, for example. This document discloses an exhaust turbocharger having an electric machine in which oil is guided to the bearings of the rotor shaft by means of spray pipes in order to supply the bearings with lubricating oil. This requires a considerable amount of installation space.

DE 11 2013 000 614 T5, which is incorporated by reference herein, likewise discloses an exhaust turbocharger having an electric machine in which oil is guided to the bearings via ducts. In this case, the oil is collected and discharged by a funnel-shaped region of the housing.

Described herein is an exhaust turbocharger which has a compact design and efficient cooling.

SUMMARY OF THE INVENTION

One exemplary embodiment of the invention relates to an exhaust turbocharger having a housing, in which a shaft is mounted by means of bearings, which carries a turbine wheel, on the one hand, and a compressor wheel, on the other hand, wherein an electric machine having a rotor and a stator is provided, wherein the rotor is secured on the shaft for conjoint rotation therewith and the stator surrounds the rotor radially on the outside, wherein a sleeve, which supports the rotor radially and axially, is arranged between the stator and the rotor, and wherein the sleeve has at least one fluid duct, by means of which a cooling fluid can be guided toward the bearings of the shaft. The arrangement of the sleeve makes it possible to implement a bearing function for the rotor and a distribution function for the cooling fluid, thus enabling a reliable supply of cooling fluid to be implemented within a small installation space.

In this context, it is expedient according to one exemplary embodiment if the turbine wheel and the compressor wheel are arranged on end regions of the shaft which are in each case arranged spaced apart from one another. In this way, a favorable design of the installation space can be implemented because the exhaust gas supplied and discharged for the purpose of driving the turbine wheel is present on one side of the shaft, and the charge air supplied and discharged from the compressor wheel is present on the other side of the shaft.

It is particularly advantageous if at least two bearings are provided, wherein in each case one of the bearings is arranged in the region of one end region of the shaft, adjacent to the turbine wheel or to the compressor wheel. Good load distribution in the region of the bearings is thereby achieved and, at the same time, installation space is created for the rotor between the bearings.

In another exemplary embodiment, it is advantageous if an electronic unit is provided which is arranged adjacent to one of the bearings and/or to the stator. It is thereby possible to provide a space-saving arrangement of the electronic unit for controlling the electric machine, in particular as power electronics, wherein the structural proximity also facilitates the supply of cooling fluid.

It is also particularly advantageous if the electronic unit is arranged axially between the turbine wheel and the compressor wheel and can have the cooling fluid flowing against it for cooling purposes. Integrated cooling of the electronic unit by the cooling fluid supply from the stator, the rotor and/or the bearings is thereby carried out in a space-efficient manner.

It is particularly advantageous if the cooling fluid can be guided to the stator by means of a fluid line, and/or if the stator is arranged in a fluid space to which cooling fluid can be fed in order to cool the stator before the cooling fluid can be guided from the stator to the fluid duct of the sleeve. Cooling of the components of the exhaust turbocharger can thereby be carried out in an advantageous way.

It is also advantageous if cooling fluid can be guided from the fluid duct of the sleeve to the rotor in order to cool the rotor.

According to advantageous refinements, the bearings can be plain bearings and/or rolling bearings, it being particularly advantageous if ball bearings are used.

BRIEF DESCRIPTION OF THE DRAWINGS

The invention is explained in detail below by means of exemplary embodiments with reference to the drawing. In the drawing.

DETAILED DESCRIPTION OF THE INVENTION

Figure 1:
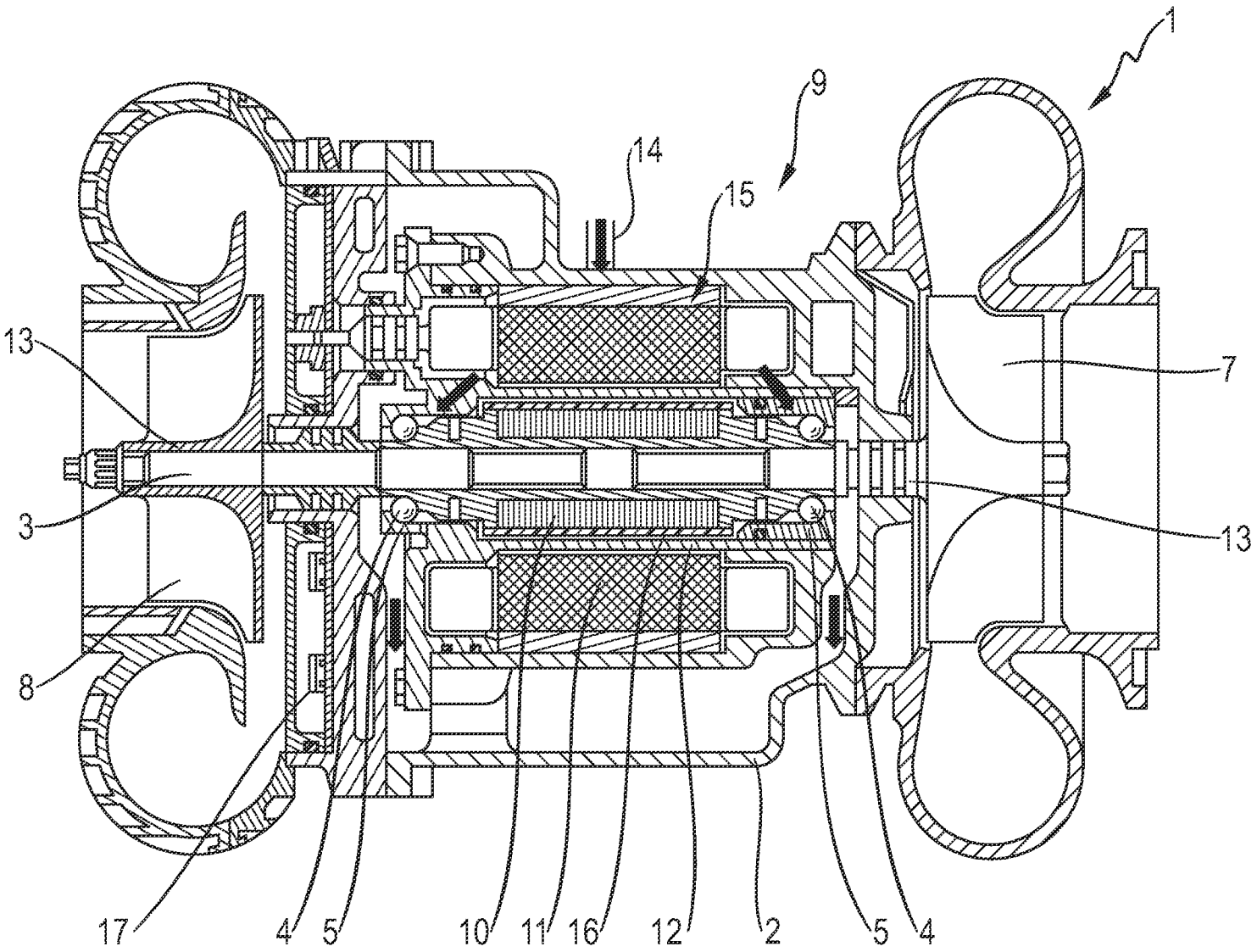
FIG. 1 shows a schematic sectional illustration of one exemplary embodiment of an exhaust turbocharger according to aspects of the invention.
Figure 2:
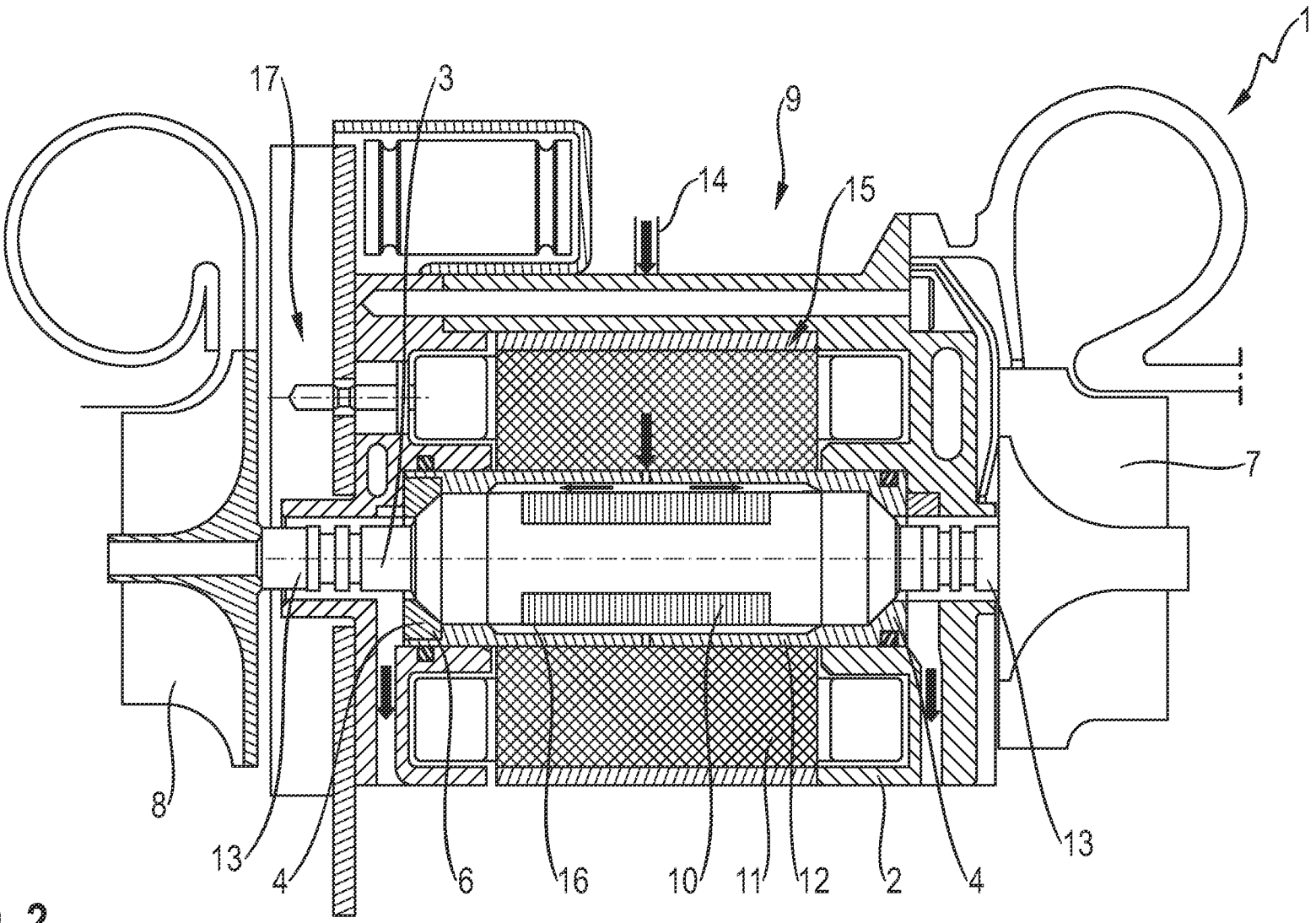
FIG. 2 shows a schematic sectional illustration of another exemplary embodiment of an exhaust turbocharger according to aspects of the invention.

FIG. 1 shows a schematic sectional illustration of one exemplary embodiment of an exhaust turbocharger 1 according to aspects of the invention, and FIG. 2 shows, in another schematic sectional illustration, another exemplary embodiment of an exhaust turbocharger 1 according to aspects of the invention. In this case, the basic configurations are similar, while differences arise, in particular, with regard to the bearings 4 used.

The exhaust turbochargers 1 shown in FIGS. 1 and 2 each have a housing 2 in which a respective shaft 3 is rotatably mounted by means of bearings 4. Here, rolling bearings 5 are used in the exemplary embodiment shown in FIG. 1, while plain bearings 6 are used in the exemplary embodiment shown in FIG. 2. Ball bearings or tapered roller bearings or the like, for example, can be used as rolling bearings.

The shaft 3 carries a turbine wheel 7, on the one hand, and a compressor wheel 8, on the other hand. The turbine wheel 7 is driven by an exhaust gas flow and thus drives the shaft 3. The compressor wheel 8 secured on the shaft 3 delivers charge air and compresses it.

From FIGS. 1 and 2 it can be seen that the turbine wheel 7 and the compressor wheel 8 are arranged on end regions 13 of the shaft 3 which are in each case arranged spaced apart from one another.

To support the shaft 3, at least two bearings 4 are provided, wherein in each case one of the bearings 4 is arranged in the region of one end region 13 of the shaft 3 and hence adjacent to the turbine wheel 7 or to the compressor wheel 8.

Furthermore, an electric machine 9 having a rotor 10 and a stator 11 is provided. The electric machine 9 serves to drive the exhaust turbocharger 1 or the shaft 3, in particular independently of an available exhaust gas flow or in addition thereto.

The rotor 10 is secured on the shaft 3 for conjoint rotation therewith and the stator 11 surrounds the rotor 10 radially on the outside, resulting in a compact design.

A sleeve 12 is arranged between the stator 11 and the rotor 10. This sleeve 12, which is preferably and by way of example made of plastic or another non-magnetizable material, serves to support the rotor 10 radially and axially relative to the stator 11 and to the housing 2. The stator 11 is preferably held fast in the housing 2.

In order to cool the stator 11, the rotor 10 and the bearings 4, a cooling fluid, in particular, for example, a lubricating oil, is guided to the stator 11 by means of a fluid line 14, and/or the stator 11 is arranged in a fluid space 15 to which cooling fluid can be fed in order to cool the stator 11. Starting from the stator 11, the cooling fluid is guided from the stator 11 to a fluid duct 16 in the sleeve 12, where the cooling fluid is divided up and guided to the bearings 4. In this case, the sleeve 12 has at least one fluid duct 16, by means of which a cooling fluid can be guided to the bearings 4 of the shaft 3 in order to cool and, if appropriate, also lubricate the bearings 4.

Preferably, cooling fluid is also guided from the fluid duct 16 in the sleeve 12 to the rotor 10 in order to be able to cool the rotor 10 as well.

An electronic unit 17 is furthermore provided which is arranged adjacent to one of the bearings 4 and/or to the stator 11. The electronic unit 17 is arranged particularly advantageously and by way of example axially between the turbine wheel 7 and the compressor wheel 8. In this case, the electronic unit 17 is arranged, in particular and by way of example, adjacent to the turbine wheel 7 or to the compressor wheel 8, arrangement adjacent to the compressor wheel being preferred for thermal reasons.

The electronic unit 17 can have the cooling fluid flowing against it for cooling purposes. In this case, the cooling fluid can be used in the forward flow or in the return flow from the bearings 4 or to the bearings 4. Alternatively, the cooling fluid can also be used in the forward or return flow of the stator 11 and/or of the rotor 10.

LIST OF REFERENCE SIGNS

1 exhaust turbocharger
2 housing
3 shaft
4 bearing
5 rolling bearing
6 plain bearing
7 turbine wheel
8 compressor wheel
9 machine
10 rotor
11 stator
12 sleeve
13 end region
14 fluid line
15 fluid space
16 fluid duct
17 electronic unit

What is claimed is:

1. An exhaust turbocharger comprising:

a housing, a shaft mounted to the housing by bearings, a turbine wheel positioned on the shaft, a compressor wheel positioned on the shaft, an electric machine having a rotor and a stator, wherein the rotor is secured on the shaft for conjoint rotation therewith and the stator radially surrounds the rotor, and a sleeve, which supports the rotor radially and axially, arranged between the stator and the rotor, and wherein the sleeve has at least one fluid duct for guiding a cooling fluid toward the bearings of the shaft.

2. The exhaust turbocharger as claimed in claim 1, wherein the turbine wheel and the compressor wheel are arranged on end regions of the shaft which are, in each case, arranged spaced apart from one another.

3. The exhaust turbocharger as claimed in claim 2, further comprising at least two bearings, wherein, in each case, one of the bearings is arranged at one end region of the shaft, adjacent to either the turbine wheel or the compressor wheel.

4. The exhaust turbocharger as claimed in claim 1, further comprising an electronic unit arranged adjacent to one of the bearings and/or to the stator.

5. The exhaust turbocharger as claimed in claim 4, wherein the electronic unit is arranged axially between the turbine wheel and the compressor wheel and is positioned to have the cooling fluid flowing against it for cooling purposes.

6. The exhaust turbocharger as claimed in claim 1, further comprising a fluid line for guiding the cooling fluid to the stator.

7. The exhaust turbocharger as claimed in claim 1, wherein the exhaust turbocharger is configured such that cooling fluid can be guided from the at least one fluid duct of the sleeve to the rotor in order to cool the rotor.

8. The exhaust turbocharger as claimed in claim 1, wherein the bearings are plain bearings, rolling bearings, and/or ball bearings.

9. The exhaust turbocharger as claimed in claim 1, wherein the stator is arranged in a fluid space to which cooling fluid can be fed in order to cool the stator before the cooling fluid can be guided from the stator to the at least one fluid duct of the sleeve.

10. The exhaust turbocharger as claimed in claim 9, further comprising a fluid line for guiding the cooling fluid to the stator.

* * * * *